US010363448B2

(12) United States Patent
Liu et al.

(10) Patent No.: US 10,363,448 B2
(45) Date of Patent: Jul. 30, 2019

(54) LIQUID BUOYANCE MUSCLE TRAINING DEVICE

(71) Applicants: Chiang Liu, Hsinchu (TW); Ya-Chen Liu, Hsinchu (TW); Wei-Han Chen, Taipei (TW); Wen-Hsuan Pan, Taipei (TW)

(72) Inventors: Chiang Liu, Hsinchu (TW); Ya-Chen Liu, Hsinchu (TW); Wei-Han Chen, Taipei (TW); Wen-Hsuan Pan, Taipei (TW)

( * ) Notice: Subject to any disclaimer, the term of this patent is extended or adjusted under 35 U.S.C. 154(b) by 71 days.

(21) Appl. No.: 15/672,300

(22) Filed: Aug. 9, 2017

(65) Prior Publication Data

US 2019/0046826 A1 Feb. 14, 2019

(51) Int. Cl.

| | |
|---|---|
| ***A63B 21/00*** | (2006.01) |
| ***A63B 21/06*** | (2006.01) |
| ***A63B 21/008*** | (2006.01) |
| ***A63B 21/062*** | (2006.01) |
| *A63B 22/00* | (2006.01) |

(52) U.S. Cl.

CPC .... *A63B 21/0084* (2013.01); *A63B 21/00058* (2013.01); *A63B 21/063* (2015.10); *A63B 21/0606* (2013.01); *A63B 2022/0079* (2013.01)

(58) Field of Classification Search

CPC ..... A63B 21/0084; A63B 21/063; A63B 21/00058; A63B 21/0606; A63B 2022/0079; A63B 21/4035; A63B 21/154; A63B 21/00069; A63B 21/0088; A63B 21/00065

See application file for complete search history.

(56) References Cited

U.S. PATENT DOCUMENTS

| | | | | | |
|---|---|---|---|---|---|
| 3,861,675 | A * | 1/1975 | Hopper | A63B 69/12 | 482/55 |
| 4,804,177 | A * | 2/1989 | Rosson | B63B 35/73 | 441/88 |
| 4,846,460 | A * | 7/1989 | Duke | A63B 21/153 | 482/73 |
| 4,884,800 | A * | 12/1989 | Duke | A63B 21/154 | 482/73 |
| 5,106,078 | A * | 4/1992 | Rowe | A63B 23/03533 | 472/128 |

(Continued)

*Primary Examiner* — Andrew S Lo
(74) *Attorney, Agent, or Firm* — Leong C. Lei

(57) ABSTRACT

A liquid buoyancy muscle training device includes a liquid receiving tank receiving and holding liquid therein. A buoyantly submergible member is buoyantly submergible in the liquid contained in the liquid receiving tank and includes a regulation chamber formed therein. A bottom pulley is mounted inside the liquid receiving tank. A rope is connected to the buoyantly submergible member and wrapped around the bottom pulley and extends upward to project outside the liquid receiving tank. A liquid regulation tank is connected through a liquid supply tube to the regulation chamber to allow liquid to flow therebetween. A gas supplier is connected through a gas supply tube to the regulation chamber to selectively supply gas into the regulation chamber to change a ratio between liquid and gas inside the regulation chamber so as to change buoyance applied to the buoyantly submergible member by the liquid contained in the liquid receiving tank.

10 Claims, 5 Drawing Sheets

(56) References Cited

U.S. PATENT DOCUMENTS

| | | | | | |
|---|---|---|---|---|---|
| 5,242,352 | A * | 9/1993 | Elliott | A63B 21/06 | 472/128 |
| 5,391,133 | A * | 2/1995 | Ruffa | A63B 21/0601 | 482/107 |
| 5,643,156 | A * | 7/1997 | Lochbaum | A63B 21/0606 | 482/111 |
| 2005/0014611 | A1 * | 1/2005 | Gearon | A63B 22/0007 | 482/73 |

* cited by examiner

LIQUID BUOYANCE MUSCLE TRAINING DEVICE

(a) TECHNICAL FIELD OF THE INVENTION

The present invention relates generally to a liquid buoyance muscle training device, and more particularly to a device that uses buoyance and pressures of liquid to provide muscle strength training and adjustment of loading of the training, particularly concerning a liquid receiving tank, a buoyantly submergible member, a bottom pulley, a rope, a liquid regulation tank, and a gas supplier.

(b) DESCRIPTION OF THE PRIOR ART

Known muscle strength training facility is provided for the purpose of training the muscle strength of people. Examples include Taiwan Utility Model M524729, which discloses a "weight training device"; M483097, which discloses a "weight device for weight training that includes minute adjustment weight blocks"; and M450394, which discloses a "weight device of weight training machine"; and Taiwan Patent No. 497426, which discloses a "minute adjustment weight device of weight training machine", all providing typical examples of muscle training devices of this kind. Such muscle training device uses metal materials, such as iron blocks or weight blocks, to provide loading necessary for training of people's muscles and the loading of training can be adjusted through adjustment of the number of the iron blocks or weight blocks involved.

Such known muscle strength training devices are generally structured to involve a number of iron blocks or weight blocks. To support up and down movement of such iron blocks or weight blocks, the muscle strength training devices must be constructed with a strong and robust structure and this needs a large amount of metallic materials, and is thus not environmentally friendly. Further, the iron blocks or weight blocks of the known muscle strength training devices may readily pinch or hit people to cause damage, and thus, the devices are generally insufficient in safety.

Training facility that uses water resistance to achieve training of muscle strength is available in the market. Examples include U.S. Pat. No. 4,884,800, which comprises a hollow container in which water is received and held and a paddle positioned in the container and rowed to cause water to rotate so a to generate water resistance; and US Patent Application Publication No. 2005/0014611 A1, which discloses a similar method for adjusting water resistance, in which an amount of liquid in a primary fluid flow zone is adjusted to make it necessary for rotating blades to expel more water so as to generate an increased resistance. However, such techniques that uses resistance to train muscle strength and adjusting resistance makes use of water resistance only and apparently, further improvements are necessary.

In view of the above, the present invention aims to provide a liquid buoyance muscle training device that overcomes or alleviates the above-discussed drawbacks.

SUMMARY OF THE INVENTION

Thus, the primary objective of the present invention is to provide a liquid buoyancy muscle training device, which comprises: a liquid receiving tank; a buoyantly submergible member comprising a regulation chamber formed therein to selectively receive and hold liquid and gas therein such that the buoyantly submergible member is buoyantly submergible in liquid contained in the liquid receiving tank; at least one bottom pulley mounted inside the liquid receiving tank with the buoyantly submergible member buoyantly located above the bottom pulley; a rope having a first end, a second end, and an intermediate section connected between the first end and the second end with the first end being connected to a bottom of the buoyantly submergible member, the intermediate section wrapped around the bottom pulley, and the second end extending above to project outside the liquid receiving tank; a liquid regulation tank connected through a liquid supply tube to the regulation chamber of the buoyantly submergible member to allow the liquid to flow between the liquid regulation tank and the regulation chamber through the liquid supply tube; and a gas supplier connected through a gas supply tube to the regulation chamber of the buoyantly submergible member and comprising a gas valve mounted to the gas supply tube so that the gas supplier selectively supplies gas through the gas supply tube into the regulation chamber in such a manner that the gas valve is operable to open and close for selectively discharging the gas contained in the regulation chamber through the gas supply tube to adjust a ratio between the liquid and the gas contained in the regulation chamber.

With the above structure, the buoyantly submergible member is operable to simultaneously receive and hold both liquid and gas in the regulation chamber so as to set the buoyantly submergible member in a buoyantly submerging condition in the liquid contained in the liquid receiving tank. To use, an operator may pull down the second end of the rope so that the intermediate section of the rope changes the direction of the force applied by the operator to have the first end of the rope pull the buoyantly submergible member to move downward. During the period in which the operator pulls the rope, the liquid contained in the liquid receiving tank applies a buoyancy force that drives the buoyantly submergible member to float upward, and at the same time, the liquid contained in the liquid receiving tank also induces a resistance force against the downward movement of the buoyantly submergible member so that a combined force of the buoyancy force and the resistance force is what the operator who pulls and moves the buoyantly submergible member downward must apply thereto. Thus, the operator must apply a force to overcome the buoyancy force and the resistive force in order to pull the buoyantly submergible member to move downward so as to greatly improve the effect of training the muscle strength. The operator, after having pull the buoyantly submergible member downward for a predetermined distance, may release the rope, so that the liquid contained in the liquid receiving tank floats the buoyantly submergible member upward for location returning, whereby the operator may repeatedly pull and release the rope and the buoyantly submergible member, and the muscle strength of the operator is thus trained.

To adjust the force that an operator must apply to pull, via the rope, the buoyantly submergible member to move downward, the gas supplier is put into operation to forcibly supply gas through the gas supply tube into the regulation chamber to forcibly expel, at least partly, the liquid contained in the regulation chamber; or alternatively, the gas valve is selectively opened to allow the gas contained in the regulation chamber to discharge outside through the gas supply tube and the gas valve so that liquid contained in the liquid regulation tank may be guided through the liquid supply tube into the regulation chamber. In this way, a ratio between liquid and gas contained in the regulation chamber can be adjusted to change the magnitude of the buoyancy force that the liquid contained in the liquid receiving tank applies to the buoyantly submergible member. This allows for adjustment, in a fast and easy way, of the necessary force that an operator applies through the rope to pull the buoyantly submergible member to move and thus helping improve easiness of use and operation and also helping reduce the amount of metallic material used, for being environmentally friendly, and also helping prevent people from being hurt by hitting or pinching by iron blocks or weight blocks, for improving operation safety. Thus, the drawbacks of the conventional muscle strength training facility, such as requiring more metallic material, being not environmentally friendly, and being easy to hit and pinch people, can be alleviated and overcome.

According to the structural features described above, the buoyantly submergible member is provided through a through hole and the liquid receiving tank comprises an ascending/descending guide member mounted in an upright manner and extending through the through hole of the buoyantly submergible member to allow the buoyantly submergible member to selectively ascend and descend along the ascending/descending guide member.

According to the structural features described above, the ascending/descending guide member comprises a through hole formed therein and therethrough and extending from an interior of the liquid receiving tank to the outside the liquid receiving tank, the intermediate section of the rope being received in and through the through hole.

According to the structural features described above, at least one top pulley is provided above the liquid receiving tank and the second end of the rope is wrapped around the top pulley to extend forward and downward therefrom.

According to the structural features described above, the liquid receiving tank is arranged in a primary housing and the liquid regulation tank is arranged in a secondary housing, the secondary housing being arranged beside the primary housing.

According to the structural features described above, the primary housing and the secondary housing are mounted on a base and a top plate is arranged above the primary housing and the secondary housing, the top pulley being mounted to a bottom surface of the top plate.

According to the structural features described above, the liquid supply tube is mounted on the base, and the base comprises at least one roller rotatably mounted thereto, the ascending/descending guide member having a bottom end fixed to a bottom of the liquid receiving tank, the ascending/descending guide member having a top end attached to the top plate.

According to the structural features described above, the bottom pulley comprises two pulleys and the rope is divided into two terminal portions in the intermediate section so as to define two sets of intermediate section and first end, the two pulleys of the bottom pulley being arranged at two opposite sides of and located under the buoyantly submergible member, the intermediate sections of the two sets being respectively wrapped around the two pulleys of the bottom pulley, two side portions of the bottom of the buoyantly submergible member being respectively connected to the first ends of the two sets.

According to the structural features described above, the second end of the rope is provided with a hand grip mounted thereto.

According to the structural features described above, the liquid supply tube is connected to a bottom of the buoyantly submergible member.

According to the structural features described above, the gas supply tube is connected to a top of the buoyantly submergible member.

According to the structural features described above, the gas supplier comprises one of an air compressor and an air pump.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
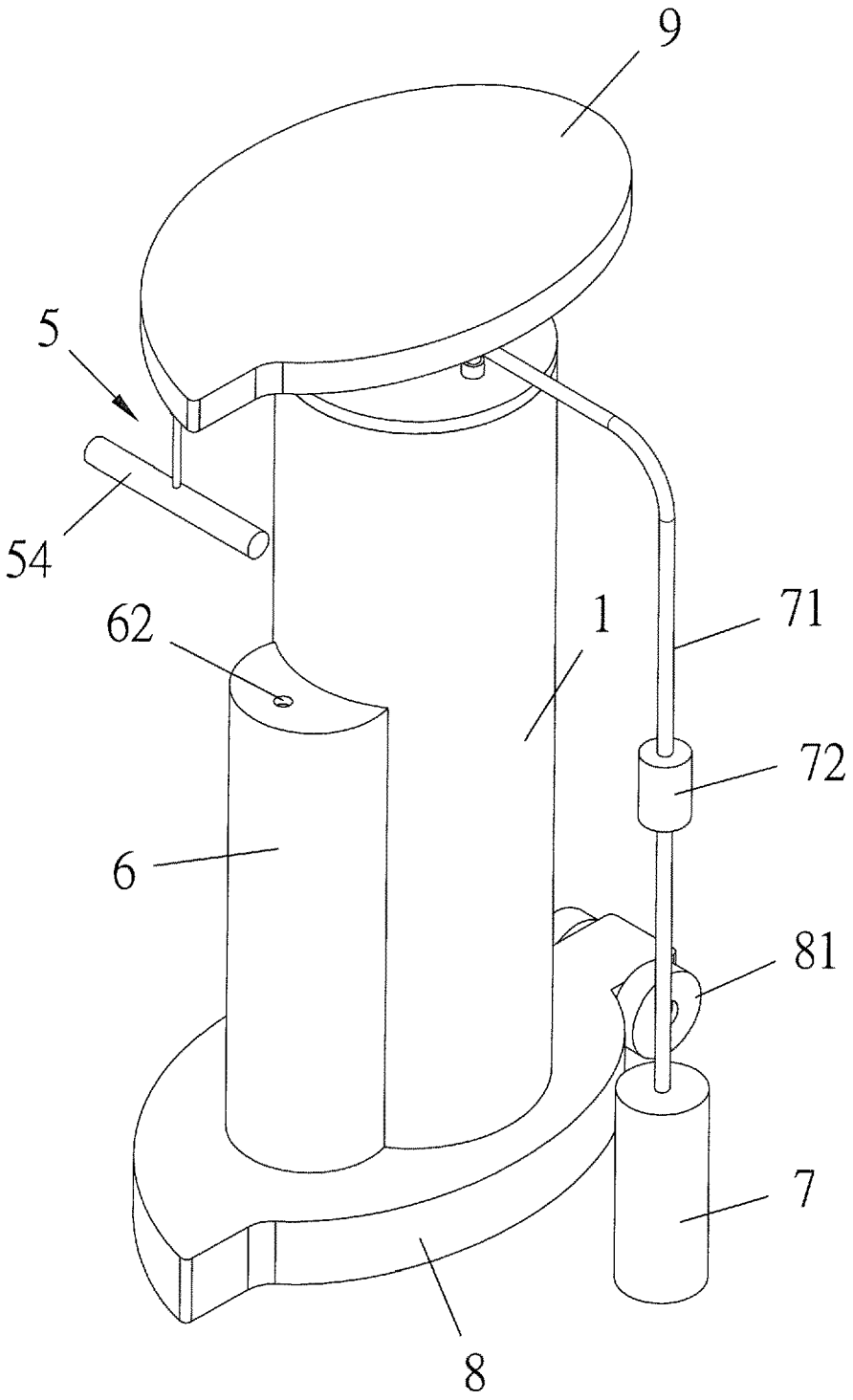
FIG. 1 is a perspective view showing a preferred embodiment of the present invention.
Figure 2:
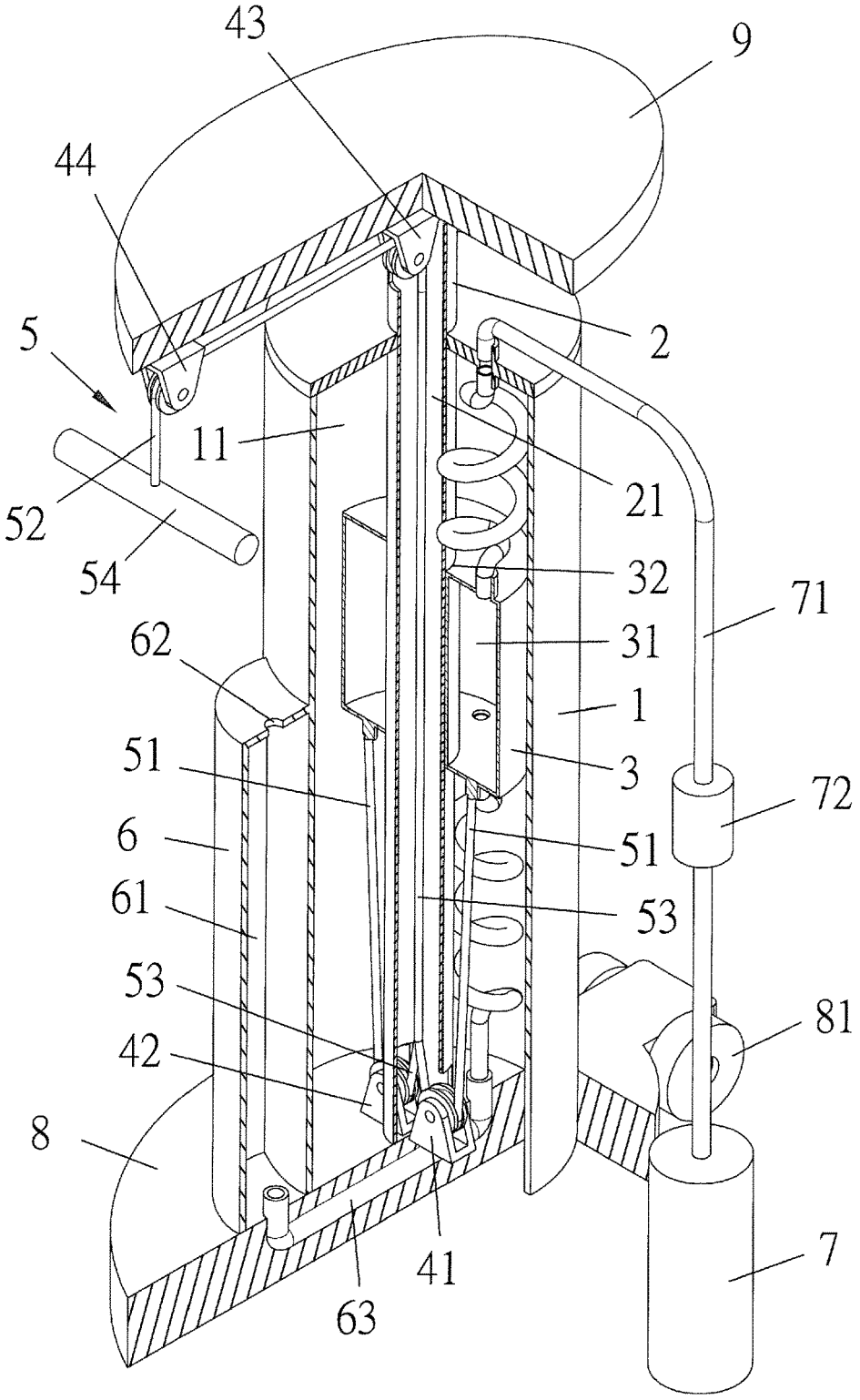
FIG. 2 is a cross-sectional view of FIG. 1.
Figure 3:
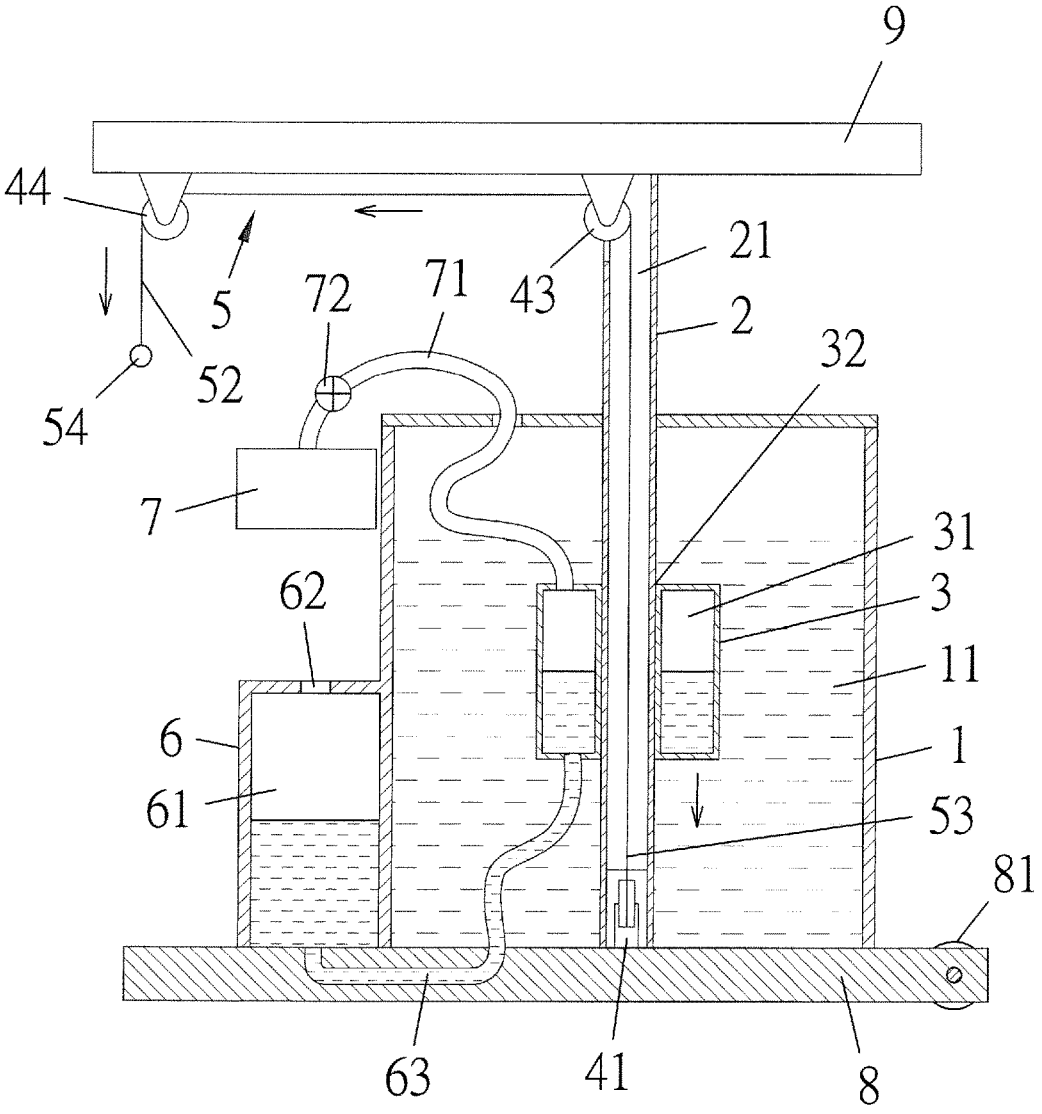
FIG. 3 is a schematic view illustrating an arrangement of FIG. 1.

Referring to FIGS. 1-3, drawings illustrating an example way of embodying the present invention are provided. As can be understood from the brief descriptions of the drawings provided above, the present invention provides a liquid buoyancy muscle training device, which comprises a structure formed by combining a primary housing 1, a buoyantly submergible member 3, at least one bottom pulley 41, a rope 5, a secondary housing 6, a gas supplier 7, a base 8, and a top plate 9. In the embodiment illustrated, the primary housing 1 is provided therein with a liquid receiving tank 11. The liquid receiving tank 11 receives and holds therein liquid (such as water). The secondary housing 6 is provided therein with a liquid regulation tank 61. The liquid regulation tank 61 also receives and holds therein liquid (such as water), and the secondary housing 6 has a top in which a gas passage hole 62 that is in communication with the liquid regulation tank 61 is formed. The secondary housing 6 is arranged beside the primary housing 1 and the primary housing 1 and the secondary housing 6 are mounted ton a top surface of the base 8. The top plate 9 is arranged, in a fixed manner, above the primary housing 1 and the secondary housing 6.

As a preferred consideration, the buoyantly submergible member 3 is provided therein with a regulation chamber 31. The regulation chamber 31 selectively receives and holds therein liquid (such as water) and gas (such as air), so as to have the buoyantly submergible member 3 buoyantly submergible in the liquid contained in the liquid receiving tank 11. The bottom pulley 41 is mounted to an interior bottom of the liquid receiving tank 11 (or the top surface of the base 8) such that the buoyantly submergible member 3 is floating above the bottom pulley 41. The liquid receiving tank 11 is provided, at a location above, with at least one top pulley 43, 44, and the top pulley 43, 44 is fixedly mounted to a bottom surface of the top plate 9. The rope 5 has a first end 51, a second end 52, and an intermediate section 53 connected between the first end 51 and the second end 52, wherein the first end 51 of the rope 5 is connected to the bottom of the buoyantly submergible member 3; the intermediate section 53 of the rope 5 is wrapped around the bottom pulley 41; and the second end 52 of the rope 5 extends upward and projects outside the liquid receiving tank 11 and the second end 52 of the rope 5 is wrapped around the top pulley 43 and further extends forward to wrap around the top pulley 44 and further extends downward to allow a hand grip 54 to attach to the second end 52 of the rope 5 for manual operation.

The drawings also show that the liquid regulation tank 61 is connected through a liquid supply tube 63 to the regulation chamber 31 of the buoyantly submergible member 3. The liquid supply tube 63 may be arranged in an interior of the base 8 and the liquid supply tube 63 is connected to a bottom of the buoyantly submergible member 3 so that liquid contained in the liquid regulation tank 61 and the regulation chamber 31 is allowed to flow between the two through the liquid supply tube 63. The gas supplier 7 may comprise an air compressor or an air pump. The gas supplier 7 is connected through a gas supply tube 71 to the regulation chamber 31 of the buoyantly submergible member 3. The gas supply tube 71 is connected to a top of the buoyantly submergible member 3 and a gas valve 72 is mounted to the gas supply tube 71. The gas supplier 7 supplies gas (such as air) through the gas supply tube 71 into an interior of the regulation chamber 31. The gas valve 72 is operable to close or open the regulation chamber 31 to selectively allow the gas contained therein to discharge through the gas supply tube 71. In the instant embodiment, the base 8 is provided, on a rear end thereof, with at least one roller 81 rotatably mounted thereto so that to move the liquid buoyancy muscle training device, sliding of the liquid buoyancy muscle training device can be achieved with the roller 81.

It is appreciated that the buoyantly submergible member 3 is structured to simultaneously receive and hold both liquid and gas in the regulation chamber 31 so as to set the buoyantly submergible member 3 in a buoyantly submerging condition in the liquid contained in the liquid receiving tank 11. To use, an operator may pull down the hand grip 54 of the second end 52 of the rope 5 so that the intermediate section 53 of the rope 5 changes the direction of the force applied by the operator sequentially through the top pulley 44, 43 and the bottom pulley 41 to have the first end 51 of the rope 5 pull the buoyantly submergible member 3 to move downward. During the period in which the operator pulls the rope 5, the liquid contained in the liquid receiving tank 11 applies a buoyancy force that drives the buoyantly submergible member to float upward, and at the same time, the liquid contained in the liquid receiving tank 11 also induces a resistance force against the downward movement of the buoyantly submergible member 3 so that a combined force of the buoyancy force and the resistance force is what the operator who pulls and moves the buoyantly submergible member 3 downward must apply thereto. Thus, the operator must apply a force to overcome the buoyancy force of upward floating in order to pull the buoyantly submergible member 3 to move downward. As such, two characteristics of water including buoyancy force and the resistance force are both utilized and in this way, the force that water applies to the buoyantly submergible member 3 can be greatly improved with only a very quantity-conservative amount of water involved to thereby greatly improve the effect of training the muscle strength. The operator, after having pull the buoyantly submergible member 3 downward for a predetermined distance, may release the rope 5, so that the liquid contained in the liquid receiving tank 11 floats the buoyantly submergible member 3 upward for location returning, whereby the operator may repeatedly pull and release the hand grip 54 of the rope 5 and the buoyantly submergible member 3, and the muscle strength of the operator is thus trained.

Figure 4:
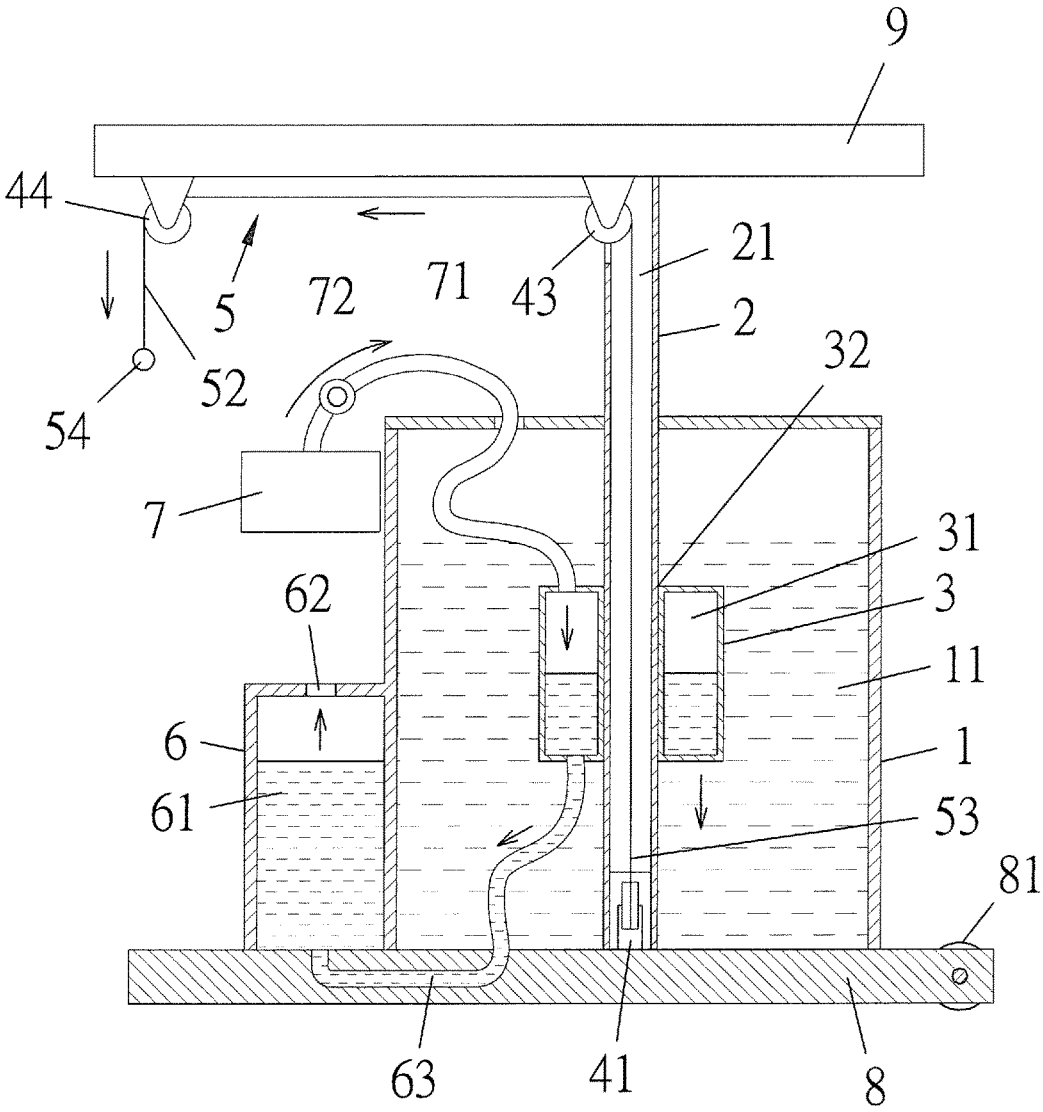
FIG. 4 is a schematic view illustrating an arrangement of FIG. 3 in a use condition.
Figure 5:
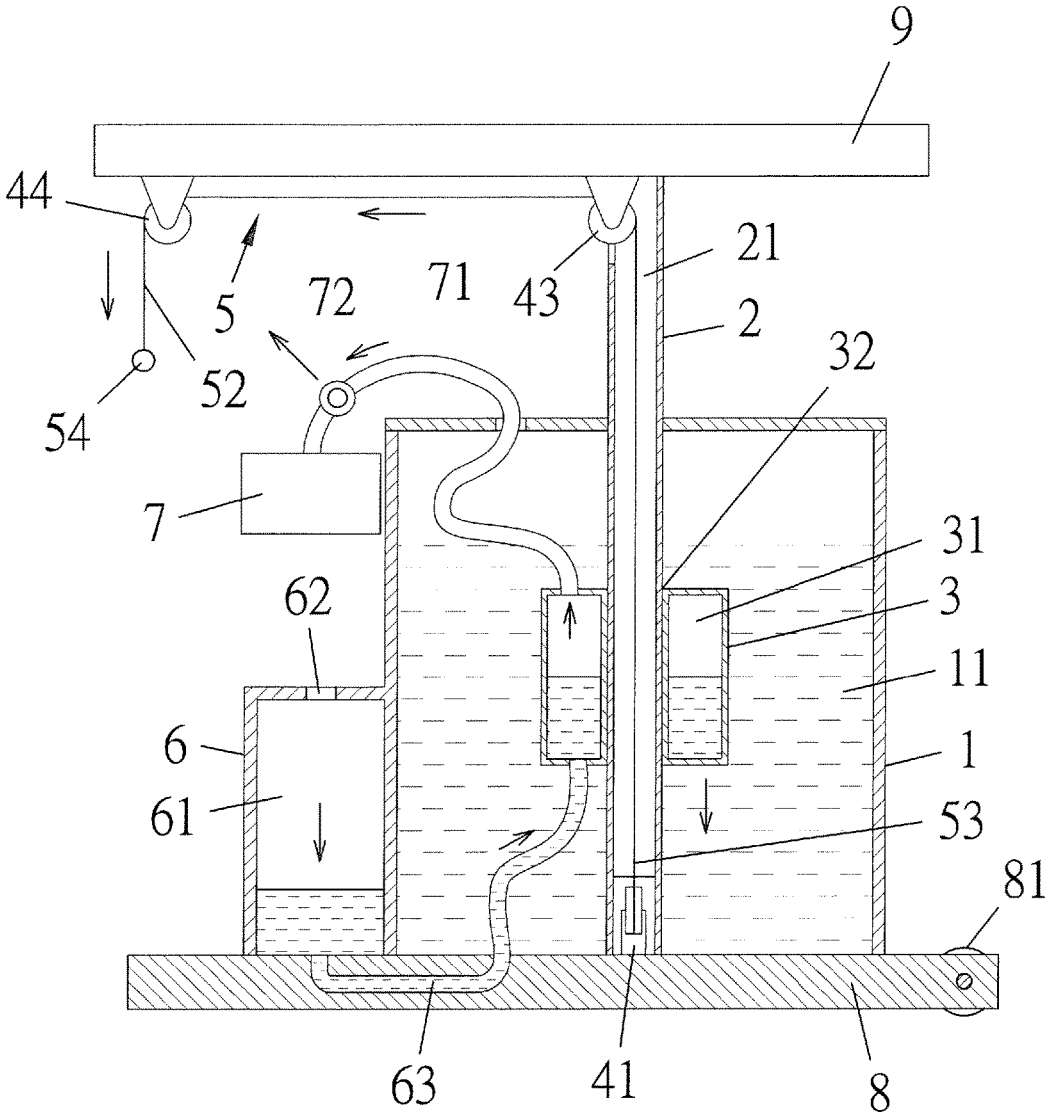
FIG. 5 is a schematic view illustrating an arrangement of FIG. 3 in another use condition.

Referring to FIGS. 3-5, to adjust the force that an operator must apply to pull, via the rope 5, the buoyantly submergible member 3 to move downward, the gas supplier 7 is put into operation to forcibly supply gas through the gas supply tube 71 into the regulation chamber 31 (as shown in FIG. 4) to forcibly expel, at least partly, the liquid contained in the regulation chamber 31 to flow through the liquid supply tube 63 back into the liquid regulation tank 61, and during such an operation, the gas passage hole 62 helps balance gas pressure inside and outside the liquid regulation tank 61. When gas inside the regulation chamber 31 is more than liquid, the buoyancy force generated by the liquid contained in the liquid receiving tank 11 and acting on the buoyantly submergible member 3 is increased and the operator must apply a larger force to pull the rope 5 in order to cause the buoyantly submergible member 3 to move downward and this provides a more intense training of the muscle strength of the operator; or alternatively, the gas valve 72 is selectively opened to allow the gas contained in the regulation chamber 31 to discharge outside through the gas supply tube 71 and the gas valve 72 (as shown in FIG. 5), so that liquid contained in the liquid regulation tank 61 may be guided through the liquid supply tube 63 into the regulation chamber 31. When liquid inside the regulation chamber 31 is more than gas, the buoyancy force generated by the liquid contained in the liquid receiving tank 11 and acting on the buoyantly submergible member 3 is decreased and the operator may apply a smaller force to pull the rope 5 to cause the buoyantly submergible member 3 to move downward and this provides a less intense training of the muscle strength of the operator.

As such, with the arrangement of the liquid regulation tank 61, the liquid supply tube 63, the gas supplier 7, the gas supply tube 71, the gas valve 72, and the buoyantly submergible member 3, a ratio between liquid and gas contained in the regulation chamber 31 can be adjusted to change the magnitude of the buoyancy force that the liquid contained in the liquid receiving tank 11 applies to the buoyantly submergible member 3. This allows for adjustment, in a fast and easy way, of the necessary force that an operator applies through the rope 5 and the hand grip 54 to pull the buoyantly submergible member 3 to move and thus allows for easy regulation of the training intensity of muscle strength, helping improve easiness of use and operation and also helping reduce the amount of metallic material used, for being environmentally friendly, and also helping prevent people from being hurt by hitting or pinching by iron blocks or weight blocks, for improving operation safety. Thus, the drawbacks of the conventional muscle strength training facility, such as requiring more metallic material, being not environmentally friendly, and being easy to hit and pinch people, can be alleviated and overcome.

As shown in FIGS. 2 and 3, in a feasible embodiment, the buoyantly submergible member 3 is provided a through hole 32 extending through and between the top and the bottom thereof and a tubular or pole-like ascending/descending guide member 2 is mounted, in an upright or erected manner, in the liquid receiving tank 11 in such a way that a bottom of the ascending/descending guide member 2 is fixedly mounted to the bottom of the liquid receiving tank 11 (or the top surface of the base 8) and a top of the ascending/descending guide member 2 is attached to the bottom surface of the top plate 9 and the ascending/descending guide member 2 extends through the through hole 32 of the buoyantly submergible member 3 to allow the buoyantly submergible member 3 to move upward and downward along the ascending/descending guide member 2. As such, movement stability of the buoyantly submergible member 3 during ascending and descending can be improved. Further, the ascending/descending guide member 2 is provided therein and therethrough with a through hole 21. The through hole 21 extends from the interior bottom of the liquid receiving tank 11 to and beyond the top of the liquid receiving tank 11. The intermediate section 53 of the rope 5 is receivable in and through the through hole 21. Further, the through hole 21 has a top opening that is adjacent to the top pulley 43, and the through hole 21 also has a bottom opening adjacent to the bottom pulley 41.

As shown in FIG. 2, in another feasible embodiment, two bottom pulleys 41, 42 are involved and the rope 5 is divided in the intermediate section 53 so as to provide two sets of intermediate section 53 and first end 51. The two bottom pulleys 41, 42 are respectively set at opposite sides of and located under the buoyantly submergible member 3 and the two intermediate sections 53 of the rope 5 are respectively wrapped around the bottom pulleys 41, 42. The bottom of the buoyantly submergible member 3 is connected, at two opposite side portions thereof, to the two first ends of the rope 5, respectively. As such, the second end 52 of the rope 5 may apply, through the two first ends 51, forces to the two side portions of the bottom of the buoyantly submergible member 3 in a substantially uniform manner to thereby further improve movement stability of the buoyantly submergible member 3 during time periods of ascending and descending.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A liquid buoyancy muscle training device, comprising:

a liquid receiving tank;

a buoyantly submergible member, which is provided therein with a regulation chamber, which selectively receives and holds liquid and gas to allow the buoyantly submergible member to selectively float in liquid contained in the liquid receiving tank;

at least one bottom pulley, which is mounted inside the liquid receiving tank such that the buoyantly submergible member is floating above the bottom pulley;

a rope, which has a first end, a second end, and an intermediate section connected between the first end and the second end, the first end being connected to a bottom of the buoyantly submergible member, the intermediate section being wrapped around the bottom pulley, the second end being arranged to extend upward to project outside the liquid receiving tank;

a liquid regulation tank, which is connected through a liquid supply tube to the regulation chamber of the buoyantly submergible member such that liquid is allowed to flow between the liquid regulation tank and the regulation chamber through the liquid supply tube; and a gas supplier, which is connected through a gas supply tube to the regulation chamber of the buoyantly submergible member, the gas supply tube comprising a gas valve mounted thereto, the gas supplier being operable to supply gas through the gas supply tube into the regulation chamber, the gas valve being operable to selectively open and close in order to selectively discharge the gas from the regulation chamber through the gas supply tube to adjust a ratio between the liquid and gas contained in the regulation chamber.

2. The liquid buoyancy muscle training device according to claim 1, wherein the buoyantly submergible member is provided with a through hole and the liquid receiving tank comprises an ascending/descending guide member mounted in an upright manner and extending through the through hole of the buoyantly submergible member to allow the buoyantly submergible member to selectively ascend and descend along the ascending/descending guide member.

3. The liquid buoyancy muscle training device according to claim 2, wherein the ascending/descending guide member comprises a through hole formed therein and therethrough and extending from an interior of the liquid receiving tank to the outside the liquid receiving tank, the intermediate section of the rope being received in and through the through hole.

4. The liquid buoyancy muscle training device according to claim 3, wherein at least one top pulley is provided above the liquid receiving tank and the second end of the rope is wrapped around the top pulley to extend forward and downward therefrom.

5. The liquid buoyancy muscle training device according to claim 4, wherein the liquid receiving tank is arranged in a primary housing and the liquid regulation tank is arranged in a secondary housing, the secondary housing being arranged beside the primary housing.

6. The liquid buoyancy muscle training device according to claim 5, wherein the primary housing and the secondary housing are mounted on a base and a top plate is arranged above the primary housing and the secondary housing, the top pulley being mounted to a bottom surface of the top plate.

7. The liquid buoyancy muscle training device according to claim 6, wherein the liquid supply tube is mounted on the base, and the base comprises at least one roller rotatably mounted thereto, the ascending/descending guide member having a bottom end fixed to a bottom of the liquid receiving tank, the ascending/descending guide member having a top end attached to the top plate.

8. The liquid buoyancy muscle training device according to claim 7, wherein the bottom pulley comprises two pulleys and the rope is divided into two terminal portions in the intermediate section so as to define two sets of intermediate section and first end, the two pulleys of the bottom pulley being arranged at two opposite sides of and located under the buoyantly submergible member, the intermediate sections of the two sets being respectively wrapped around the two pulleys of the bottom pulley, two side portions of the bottom of the buoyantly submergible member being respectively connected to the first ends of the two sets.

9. The liquid buoyancy muscle training device according to claim 1, wherein the bottom pulley comprises two pulleys and the rope is divided into two terminal portions in the intermediate section so as to define two sets of intermediate section and first end, the two pulleys of the bottom pulley being arranged at two opposite sides of and located under the buoyantly submergible member, the intermediate sections of the two sets being respectively wrapped around the two pulleys of the bottom pulley, two side portions of the bottom of the buoyantly submergible member being respectively connected to the first ends of the two sets.

10. The liquid buoyancy muscle training device according to claim 1, wherein the second end of the rope is provided with a hand grip mounted thereto, the liquid supply tube being connected to a bottom of the buoyantly submergible member, the gas supply tube being connected to a top of the buoyantly submergible member, the gas supplier comprising one of an air compressor and an air pump.

* * * * *